US006113199A

United States Patent [19]

Foote

[11] Patent Number: 6,113,199

[45] **Date of Patent: *Sep. 5, 2000**

[54] LABORATORY COUNTERTOP

[75] Inventor: David K. Foote, Morganton, N.C.

[73] Assignee: Kewaunee Scientific Corporation, Statesville, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/149,757

[22] Filed: Sep. 8, 1998

Related U.S. Application Data

[63] Continuation-in-part of application No. 08/975,550, Nov. 20, 1997.

[51] Int. Cl.[7] ..... A47B 96/18

[52] U.S. Cl. ..... 312/140.3; 108/90; 52/309.13; 52/796.11

[58] Field of Search ..... 312/140.1, 140.2, 312/140.3; 108/90, 27; 52/309.13, 782.2, 782.21, 796.11, 782.22

[56] References Cited

U.S. PATENT DOCUMENTS

| | | | |
|---|---|---|---|
| 2,411,620 | 11/1946 | English | 312/140.2 |
| 3,077,012 | 2/1963 | Speraw | 52/782.22 |
| 3,583,337 | 6/1971 | Yokeley | 108/90 |
| 3,606,508 | 9/1971 | Burnes | 312/140.3 |
| 3,730,812 | 5/1973 | Prisk et al. | 156/380 |
| 5,234,743 | 8/1993 | Fleischle | 428/413 X |
| 5,419,264 | 5/1995 | Davis | 312/140.1 |
| 5,566,481 | 10/1996 | Lehrman | 38/140 |
| 5,613,342 | 3/1997 | Nelson | 52/782.2 |

*Primary Examiner*—Peter M. Cuomo
*Assistant Examiner*—Stephen Vu
*Attorney, Agent, or Firm*—Alston & Bird LLP

[57] ABSTRACT

The laboratory countertop of the present invention utilizes a thin chemical and heat resistant surfacing panel in the form of a thin planar sheet made of a cured thermoset resin composition. In accordance with one broad aspect of the present invention, the thin chemical and heat resistant surfacing panel is mounted overlying a backing panel of a less expensive and lighter material such as particle board or plywood. The surfacing panel is of a cast, monolithic construction and has a width at least 50 times its thickness and a length at least 100 times its thickness. The surfacing panel can additionally include an edge flange integrally formed with the thin planar sheet. The edge flange hides the underlying backing panel from view and gives the countertop the appearance of a unitary thick slab.

19 Claims, 3 Drawing Sheets

10
11
12
13
14
15
2
21
22
23
24
25
26
27
28
61
62

LABORATORY COUNTERTOP

CROSS REFERENCE TO RELATED APPLICATIONS

This application is a continuation-in-part of commonly owned, copending U.S. Application No. 08/975,550 filed Nov. 20, 1997.

FIELD AND BACKGROUND OF THE INVENTION

This invention relates to laboratory countertops and to the manufacture of laboratory countertops.

Countertops for use in laboratories must withstand severe environmental conditions. They must be resistant to strong chemicals such as solvents, acids and corrosive compositions, and they must also withstand severe physical conditions such as impacts and localized heating without breaking or cracking. The countertop must have a smooth, impermeable surface which is easy to clean. To meet these demanding performance requirements, many laboratory countertops have been formed from an epoxy composition. Typically, the countertop comprises a thick slab of cured epoxy resin containing a mineral filler. The slabs are cast in thicknesses of approximately 1 inch to 1 ½ inches, in lengths of up to 8 feet and in widths of up to 4 feet. Epoxy countertops of this general type have performed quite well under the demanding environmental conditions encountered in laboratories, and have been used extensively. Indeed, this type of countertop is used in most academic and industrial laboratory countertop installations. However, a drawback to this type of countertop is that it is quite heavy. A typical epoxy countertop slab may weight 10 pounds or more per square foot. Thus, the material cost and shipping expense is significant and the weight also makes handling and installation difficult.

Thinner sheets of an epoxy composition on the order of about ¼ to ⅜ inch thick have been produced for use in less severe environments, for example as liners for fume hoods, by casting in an open horizontal mold. However, this method is incapable of meeting the exacting dimensional tolerances and flatness requirements of countertop applications. Also, the requirements for impact resistance and heat resistance are less severe than in countertop applications.

SUMMARY OF THE INVENTION

The present invention provides a laboratory countertop which overcomes the significant limitations and disadvantages of conventional thick epoxy slab countertops. The laboratory countertop utilizes a thin chemical and heat resistant surfacing panel in the form of a planar sheet made of a cured thermoset resin composition. The planar cast sheet has a thickness of no more than about ½ inch. In accordance with one broad aspect of the present invention, the thin chemical and heat resistant surfacing panel is mounted overlying a backing panel of a less expensive and lighter material such as particle board or plywood. The surfacing panel can additionally include an edge flange integrally formed with the thin planar sheet. The edge flange hides the underlying backing panel from view and gives the countertop the appearance of a unitary thick slab.

Pursuant to the present invention, the thin planar cast sheet can be produced with exacting dimensional tolerances. Precise uniformity of thickness is essential if the thin sheet material is to be used as an overlay over a less expensive backing panel to form a composite countertop. In accordance with the present invention, the thin planar sheet can be produced with a variation in thickness of no more than 10 percent throughout its length and width dimensions. The thin planar cast sheet can be produced with the high levels of surface smoothness and hardness required in a countertop installation. The surfacing panel is of a cast, monolithic construction and may be formed with a width at least 50 times its thickness and a length at least 100 times its thickness.

The surfacing panel is preferably formed from a thermoset resin composition which contains at least 50 percent by weight inorganic filler. One particularly suitable thermoset resin composition comprises a cured and hardened liquid epoxy resin, such as bisphenol A-based epoxy resin. The epoxy composition may also include a pigment for imparting to the countertop a predetermined overall base color. Decorative particles of a color contrasting to the base color may be dispersed throughout the pigmented epoxy composition to impart a decorative appearance to the countertop resembling granite or other natural stone material.

The thin resin countertop in accordance with the present invention is suitably produced in a closed vertical mold. The method comprises forming a castable liquid composition comprising a thermosetting resin, mineral filler and hardener and introducing the castable liquid composition into a mold cavity defined between a pair of opposed planar walls mounted in a vertical orientation and narrowly spaced apart from one another. For countertop applications and other applications requiring thin sheets with precise dimensional tolerances in thickness, the mold walls are spaced apart a distance of about ½ inch or less, and desirably about ⅜ inch or less. The castable liquid composition is cured and hardened in the mold cavity to produce a countertop and the countertop is then removed from the mold cavity. The castable liquid composition is cured and hardened by heating the composition in the mold at an elevated temperature. For example, the heating may be accomplished by placing the mold in an oven at a temperature of at least 250° F.

BRIEF DESCRIPTION OF THE DRAWINGS

Some of the features and advantages of the invention having been described, others will become apparent from the detailed description which follows, and from the accompanying drawings, in which.

DESCRIPTION OF ILLUSTRATED EMBODIMENTS

Figures 1, 2, 3:
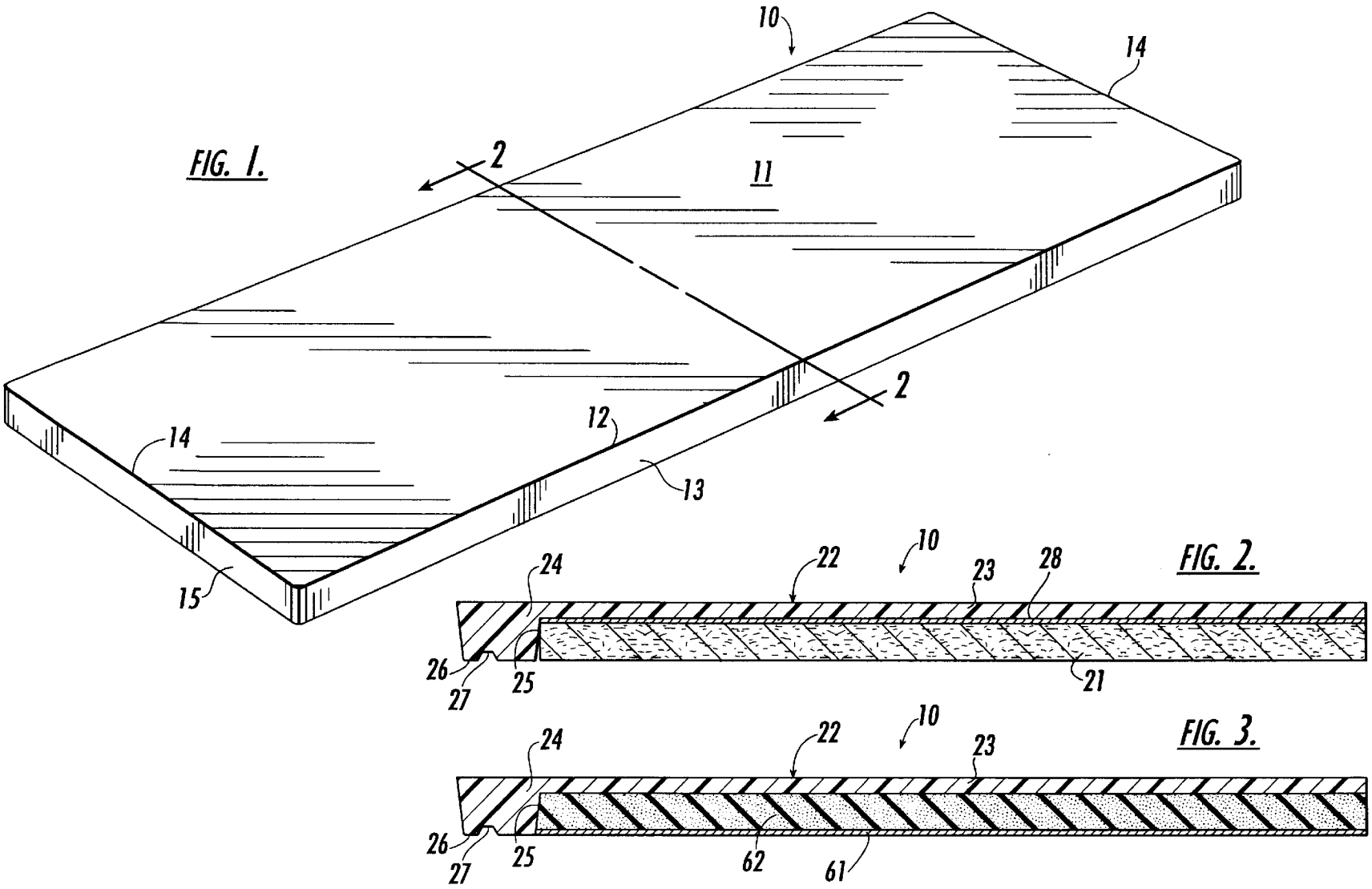
FIG. 1 is a perspective view showing a laboratory countertop in accordance with the present invention.
FIG. 2 is a cross-sectional view of the countertop taken substantially along the line 2—2 of FIG. 1.
FIG. 3 is a cross-sectional view of a countertop in accordance with another embodiment of the invention.

In FIG. 1, reference character 10 generally indicates a laboratory countertop in accordance with the present invention. Although not drawn to scale, the laboratory countertop 10 shown in FIG. 1 would have an overall thickness of about 1 inch, a width of approximately 3 feet, and a length of as much as about 8 feet. The countertop 10 has a substantially smooth and planar upper surface 11. Adjoining the upper surface along the front longitudinal top edge 12 is a front surface 13 also formed of the same molded cured epoxy resin. The front surface 13 is integral with the top surface 11 and has a height of approximately 1 inch. Also adjoining the top surface 11 along the side longitudinal top edges 14 are side surfaces 15 which are integral with the top surface 11 and front surface 13. Thus, when viewed from the front as shown in FIG. 1, the laboratory countertop has the appearance of a solid thick slab. However, as seen from FIG. 2, the laboratory countertop is actually of a composite construction. The composite laboratory countertop includes a backing panel 21 and an overlying chemical resistant and heat resistant surfacing panel 22. In the embodiment illustrated in FIGS. 1 and 2, the backing panel comprises a rigid panel made of particle board. Other suitable materials for the backing panel 21 could include wood, plywood, chip board, plastics, cement board, structural foam, honeycomb panels or corrugated panels. The material for the backing 21 is selected to be of relatively light weight and of low cost while providing a rigid support for the overlying surfacing panel 22.

FIG. 3 illustrates an alternative embodiment in which the backing panel is of a composite foam core construction. To avoid repetition, elements in this embodiment which correspond to those previously described are identified with the same reference numbers. In the embodiment of FIG. 3, the backing panel 21' comprises a relatively thin, planar rear panel 61 forming the rear surface of the countertop and a foam core 62 located between the surfacing panel 22 and the rear panel. The rear panel 61 is spaced from the inwardly facing surface 25 of surfacing panel 22 forming a cavity therebetween which is filled by the form core 62. The foam core may be produced by injecting a foamable composition into the cavity and allowing it to expand and fill the cavity. The formulation of the foamable composition is selected so that the foam will adhere to surface 25 and to the rear panel 61 to form a unitary composite structure. Suitable foamable compositions include polyester, polystyrene, polyurethane, polyethylene and polyvinyl chloride (PVC). The composition may include fillers and additives, such as silica, calcium carbonate, hydrated alumina, talc, clay and fly ash. A particularly preferred composition is 1 part hydrated alumina to 4 parts polyurethane. Various commercially available polyurethane composition can be suitably employed, such as a two component rigid polyurethane foam system using a urethane resin and a polymeric MDI (diphenylmethane diisocyanate).

The surfacing panel 22 is of a unitary monolithic construction formed of a cured thermoset resin composition. As seen in FIG. 2, the surfacing panel 22 includes a thin planar cast sheet 23 which overlies the entire width and length of the backing panel 21. The rigid cast sheet 23 has planar front and rear surfaces with a thickness of up to about ½ inch, preferably up to about ⅜ inch, and most desirably on the order of about ¼ inch. The sheet 23 has a uniform thickness throughout the extent of its length and width dimensions. Preferably, the planar cast sheet 23 has a major thickness which varies no more than 10 percent throughout the length and width of the sheet.

As seen in FIG. 2, the surfacing panel 22 includes edge flange 24 which is integrally formed with the cast thin sheet 23. The edge flange 24 includes an outwardly facing surface which forms the front surface 13 of the panel 22 and an inwardly facing surface 25 which extends downwardly from the rear surface of the sheet 23 and is positioned adjacent an edge of the backing panel 21. The flange also has a bottom surface 26 in which there is formed a molded drip groove 27. In the event that a liquid is spilled on the countertop, the drip groove serves to prevent spilled liquid from running under the countertop and into any underlying cabinets. Instead, the liquid will be stopped by the drip groove and will drip from the countertop at this location.

The surfacing panel 22 and the backing panel 21 are secured together to form a unitary composite structure. In the illustrated embodiment, this is achieved by an adhesive layer 28 between the upper surface of the backing panel 21 and the rear surface of the thin sheet 23. To provide enhanced adherence for the adhesive, the rear surface of the sheet 23 may optionally be provided with a textured surface.

The integral edge flange can also be provided, when desired, along the side edges of the laboratory countertop. In this instance, the side surface 15 of the countertop is the outwardly facing surface of the integral edge flange. Although the side edge flanges are not shown in detail in the drawings, they would have an appearance similar to that shown in FIG. 2. The resulting countertop would have a finished appearance along the front edge and both side edges. The integral edge flange could also be provided along the rear edge of the countertop, in which case the resulting countertop would have a finished appearance along all four edges.

In order to provide the high levels of chemical resistance, hardness, impact resistance and heat resistance required for laboratory installations, the surfacing panel is formed of a strong heat resistant thermoset resin composition. Particularly preferred for this purpose are epoxy resins. Epoxy resins provide a combination of excellent strength, toughness, chemical resistance, adhesive and electrical properties. The preferred epoxy resin for use with the present invention is a liquid bisphenol-A (bis A) epoxy resin. This type of epoxy resin composition is available commercially from various sources, as will be well appreciated by those skilled in the art. Such resins are available with various viscosities, ranging from about 400 to about 25,000 cps at 25° C. For example, one suitable liquid bis A-based epoxy resin is D.E.R. 331, manufactured by The Dow Chemical Company of is Midland, Mich. D.E.R. 331 is a widely used, general purpose liquid epoxy resin with a viscosity of about 11,000 to 14,000 and an epoxide equivalent weight of about 182–192. Other liquid epoxy resins which could be used as an alternative to the use of a bis A-type liquid epoxy resin include epoxy vinyl ester resins and epoxy novalac resins. Epoxy novalacs, unlike bisphenol A epoxies have multiple epoxide groups on the resin backbone. This multifunctionality produces a more tightly cross-linked system resulting in better elevated temperature performance and chemical resistance than bis A-based resins. Vinyl ester resins are the reaction products of epoxy resins and vinyl terminated acids. Vinyl ester resins are characterized by excellent corrosion and solvent resistance.

Epoxy resins may be polymerized with a variety of curing agents or hardeners. Persons skilled in the art may select from any of a number of commercially available curing agent or hardener systems. Conventional epoxy curing agents include polyamides, polysulfides, aliphatic amines, aromatic amines, amidoamines, anhydrides, and formaldehyde-based curing agents, with anhydrides being preferred. For use in the closed vertical mold casting process described herein, it is desirable to select a curing agent which will allow for handling of the composition at room temperature for up to one hour after mixing the curing agent and epoxy resin, with curing occurring upon heating to elevated temperatures of about 175° F. or higher. Preferably, the elevated temperature cure rate is such that the molded article will cure and harden sufficiently within 1 to 2 hours for removal from the mold. An accelerator, promoter or catalyst may also be employed. Conventional accelerators or promoters include amines, imidazole derivatives or quaternary ammonium compounds.

The epoxy composition also includes a particulate mineral filler, preferably in amounts of at least 50 percent by weight based on the total composition. Suitable inorganic fillers include alumina, silica, talc, clay, crushed stone, calcium carbonate and magnesium hydrate. In the present invention, the preferred filler is hydrated alumina. Alumina concentrations up to 200 parts alumina per 100 parts of epoxy resin are feasible. Hydrated alumina increases pot life and decreases exotherm because the concentration of reactants in a given mass is reduced and because alumina is a better heat conductor than the epoxy resin. Alumina also helps to increase thermal shock resistance and decrease the coefficient of thermal expansion by replacing part of the resin with a material that does not significantly change with temperature variations. Alumina also decreases shrinkage of the final product by replacing reactive resin with inert material. The preferred hydrated alumina is alumina trihydrate (ATH).

Colored pigments can be used for imparting a desired color to the resin. Typically, pigment concentrations vary from 0.2 to 1 parts per 100 parts resin. Nonexaustive and nonlimiting examples of pigments which can be used in the epoxy resin system include aluminum, titanium dioxide, iron oxide, lampblack, chromium oxide, phthlocyanine blue, and molybdate orange. Optionally, decorative particles or flakes can be mixed with the composition so as to be dispersed in a resin matrix. When the surface is sanded and polished various decorative effects can be achieved, such as a granite-like appearance or a terrazzo-like appearance.

Figure 4:
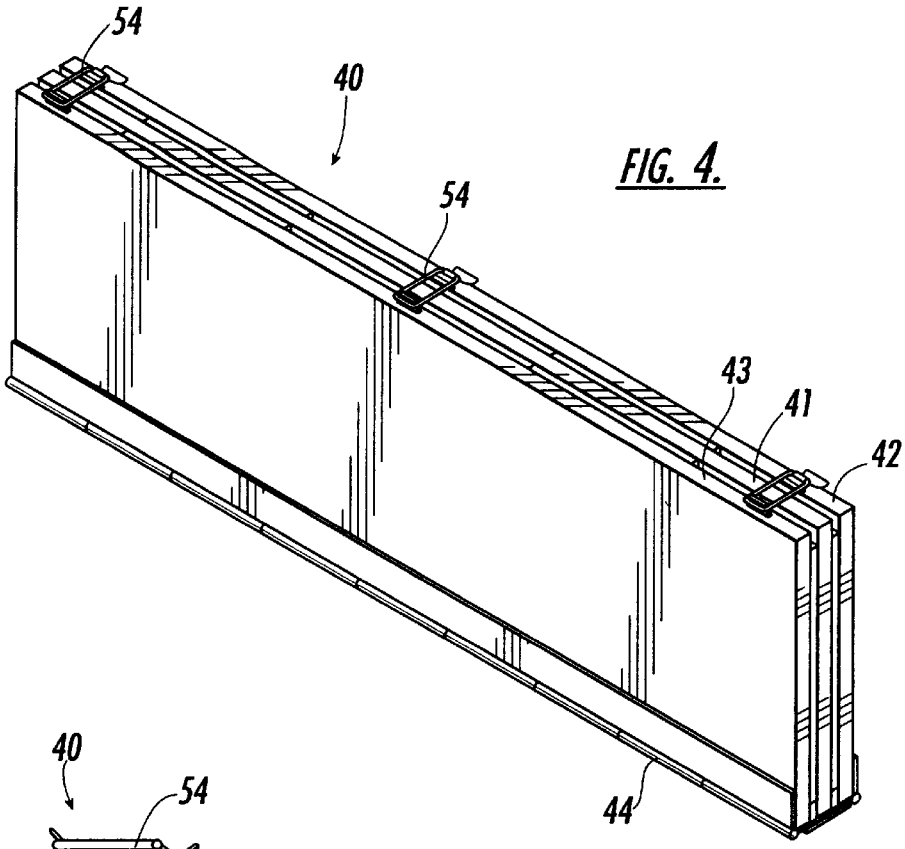
FIG. 4 is a schematic perspective view showing a mold apparatus for producing the thin epoxy panels used in the laboratory countertop.
Figure 5:
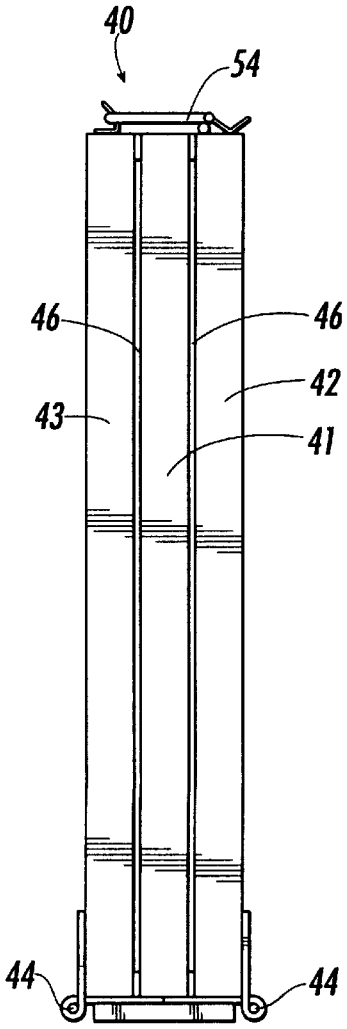
FIG. 5 is an end view of the mold.
Figures 6, 6A:
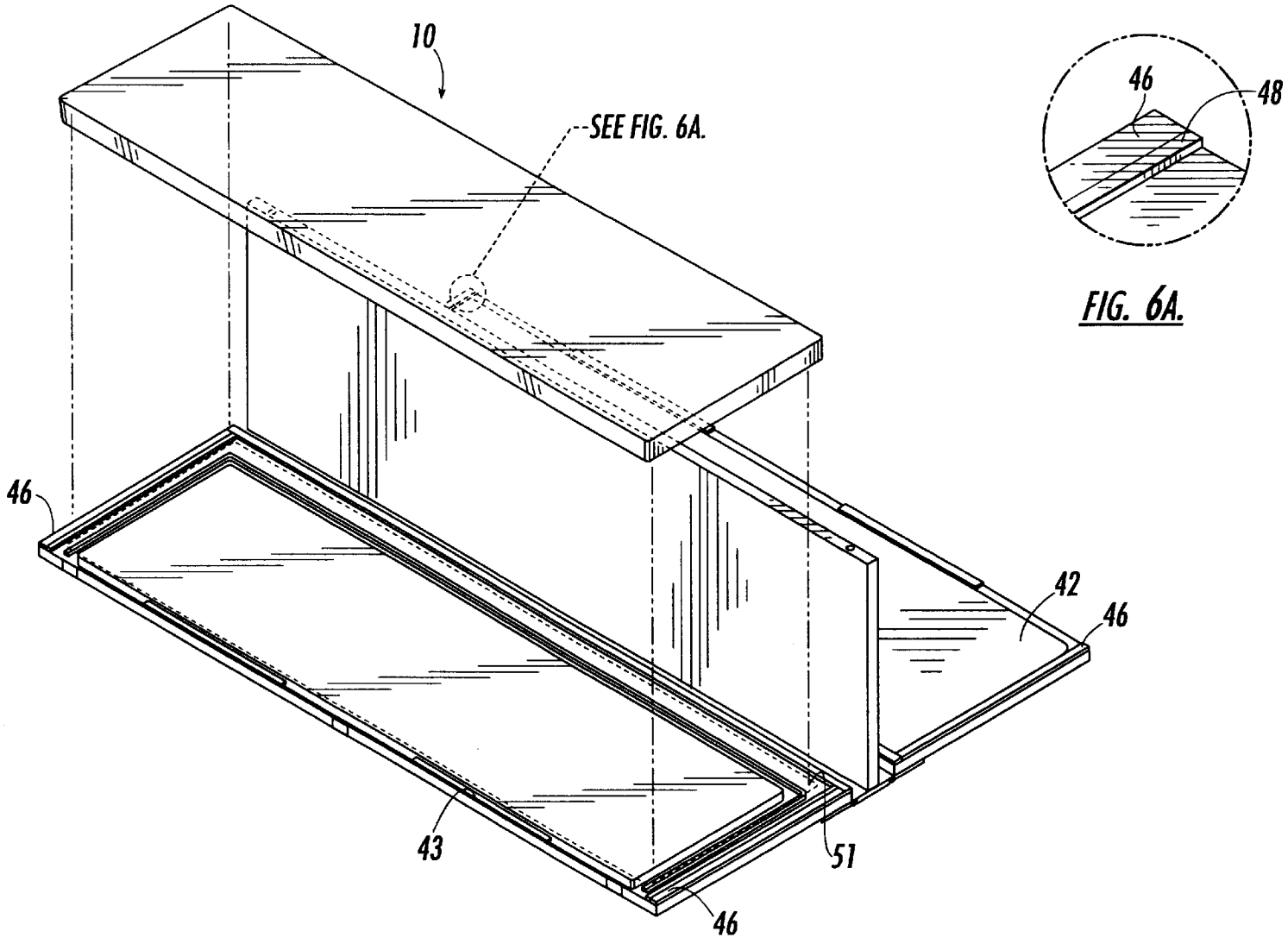
FIG. 6 is a perspective view similar to FIG. 4 but showing the mold in the open condition to allow removal of the molded epoxy resin sheet.
FIG. 6A is an exploded fragmentary detailed view of a portion of the mold shown in FIG. 6.

FIG. 4 illustrates a suitable mold apparatus 40 with two closed vertical mold cavities designed for simultaneously casting two countertops. The closed vertical mold makes it possible to produce very thin resin sheets with precise dimensional tolerances. The mold is formed from thick rigid metal slabs or plates, such as aluminum. The mold includes a stationary center mold plate 41 and outer moveable mold plates 42, 43. The center stationary mold plate 41 is mounted in a vertical orientation and has smooth outer surfaces which form the top surface 11 of the countertop. Hinges 44 are connected to the outer mold plates 42 and 43 along their lower longitudinal edge and allow the outer mold plates to be moved from the vertical position shown in FIGS. 4 and 5 in which the mold plates 41, 42 and 43 cooperate to form closed mold cavities, to an open position as shown in FIG. 6 which allows for removal of the countertop from the mold. As seen in FIG. 6, a trim strip 46 is mounted along the bottom edge and opposing side edges of the outer mold plates 42 and 43. The trim strip 46 has a thickness corresponding to the intended thickness of the molded polymer sheet 23. Thus for example, for producing a sheet ¼ inch in thickness, the trim strip 46 has a thickness of ¼ inch and thus serves as a spacer for spacing the outer mold plates 42 and 43 from the inner mold plate 41 a uniform distance to provide the precise thickness tolerances required in accordance with the present invention. The length and width dimensions of the mold plates are many times greater than the thickness dimension, enabling the mold to produce sheets having a width of at least 50 times the thickness, or even 100 times the thickness or higher, and a length dimension at least 100 times the thickness, or even 250 times the thickness or higher. A flexible seal 48 is mounted alongside the trim strip 46 to facilitate obtaining a tight seal when the mold is in the closed position.

A trim strip 47 is also mounted alongside the top edge of the outer mold plates 42, 43 for spacing the outer mold plates 42, 43 from the center mold plate 41 in this location. However, as shown, the trim strips 47 do not run the entire length of the mold plate. Thus, openings are left for filling the mold with resin.

In order to produce the integrally molded edge flange, a recess or cavity 51 is provided in the outer mold plates. In the illustration given in FIG. 6, the outer mold plate 42 is designed for forming a flat panel of uniform thickness throughout, and the mold plate is therefore not provided with a recess 51. The mold plate 43 on the other hand is provided with a longitudinal recess 51 along the lower edge which forms the integral edge flange 24.

If a textured surface is desired on the rear surface of the countertop, the mold surface of the outer mold plate 42 or 43 may be lined with a textured sheet, such as a Teflon coated woven fabric for example or by imparting texture to the mold surface itself.

In use, the mold is closed by pivoting the outer mold plates 42, 43 to their upward position and clamping the mold plates in position using a suitable clamping device, such as clamps 54 as shown in FIG. 1.

Prior to filling the mold, the mold is preferably preheated to an elevated temperature, for example 300° F. Using a trough-type funnel, the liquid epoxy mixture is introduced into the fill openings at the top of the mold. Once the mold is full, it is heated to promote curing of the resin mixture. For example, the mold may be placed in an oven at a temperature of at least 250° C., preferably about 320° F., for 2 hours. Afterwards, the mold is removed from the oven and opened and the epoxy resin countertop is removed from the mold. The countertop may be allowed to cool fully within the mold, or it may be removed from the mold while still warm and somewhat flexible and placed on a flat surface where it is allowed to cool slowly until it is fully hardened. At this point, the countertop should be ready for subsequent processing.

The countertop may then be assembled with the backing panel. This involves cutting the substrate backing panel to the proper size, applying a suitable adhesive 28 to the substrate, positioning the surfacing panel 23 and then applying pressure to achieve a secure bond between the backing panel 21 and the resin surfacing panel 23. Subsequently, if necessary, the composite countertop can be cut to the finished size.

The surface of the countertop and the exposed edges may be sanded and polished to provide a smooth finished surface. For certain specific applications, cutouts may be made in the countertop for sinks, plumbing fixtures and the like.

That which is claimed is:

1. A laboratory countertop comprising a backing panel having a front surface, opposing side edges, and opposing end edges, and a chemical and heat resistant surfacing panel overlying said front surface of said backing panel; said surfacing panel comprising a thin planar sheet of a cured, thermoset resin composition, said thin planar sheet having a thickness of up to about ½ inch, and an edge flange portion integrally and continuously molded with said thin planar sheet, said edge flange having an inwardly facing surface positioned adjacent at least one of said edges of said backing panel and an outwardly facing surface adjoining an outer surface of said thin planar sheet, the edge flange covering the backing panel and presenting the countertop with an appearance of a unitary thick slab.

2. A countertop according to claim 1, wherein said thin planar sheet of said surfacing panel is of a monolithic cast construction and has a width at least 50 times its thickness and a length at least 100 times its thickness.

3. A countertop according to claim 2, wherein the thickness of said thin planar sheet varies no more than 10 percent throughout its width and length dimensions.

4. A countertop according to claim 1, wherein said thin planar sheet of said surfacing panel has a substantially smooth outer surface and a textured inner surface facing said backing panel, and said countertop includes an adhesive layer between said surfacing panel and said backing panel.

5. A countertop according to claim 1, wherein said thermoset resin composition of said surface panel comprises at least 50 percent by weight inorganic filler.

6. A countertop according to claim 5, wherein said thermoset resin composition comprises a cured and hardened liquid epoxy resin.

7. A countertop according to claim 5, wherein said resin composition includes a pigment for imparting to the countertop a predetermined overall base color, and decorative particles of a color contrasting to said base color dispersed throughout said resin composition to impart a decorative appearance to the countertop.

8. A countertop according to claim 7, wherein the outer surface of said surfacing panel has been ground and polished to expose portions of said decorative particles in a surrounding planar matrix of pigmented resin.

9. A countertop according to claim 1, wherein said backing panel is a rigid panel made of a material selected from the group consisting of wood, plywood, particle board, chip board, plastics, cement board, structural foam, honeycomb panels, and corrugated panels.

10. A countertop according to claim 1, wherein said backing panel comprises a rigid particle board panel having a substantially planar front surface, and wherein an adhesive layer is provided between said front surface of said backing panel and the rear surface of said surfacing panel securing the surfacing panel and the backing panel together to form a unitary composite structure.

11. A countertop according to claim 1, wherein said backing panel comprises a relatively thin rear panel extending parallel to said surfacing panel and spaced therefrom and a foam core disposed between said surfacing panel and said rear panel.

12. A countertop according to claim 11, wherein said foam core comprises a rigid foam composition filling a space between said surfacing panel and said rear panel and being adhered to said surfacing panel and said rear panel, said foam core securing the surfacing panel and said rear panel together to form a unitary composite structure.

13. A countertop comprising a backing panel having a substantially planar front surface, opposing side edges, and opposing end edges, and a chemical and heat resistant monolithic cast surfacing panel overlying said front surface of said backing panel, said surfacing panel comprising a thin planar sheet formed of a cured, thermoset composition comprising an epoxy resin, mineral filler and pigments, said thin planar sheet having a thickness of up to about ⅜ inch, a width at least 50 times its thickness, and a length at least 100 times its thickness, and an edge flange portion integrally and continuously molded with said thin planar sheet, said edge flange having an inwardly facing surface positioned adjacent at least one of said edges of said backing panel and an outwardly facing surface adjoining an outer surface of said thin planar sheet, the edge flange covering the backing panel and presenting the countertop with an appearance of a unitary thick slab.

14. A countertop according to claim 13, wherein said surfacing panel is formed of a cured thermoset composition comprising an epoxy resin and at least 50 percent by weight inorganic filler.

15. A countertop according to claim 13, wherein said cured thermoset composition includes a pigment for imparting to the countertop a predetermined overall base color, and decorative particles of a color contrasting to said base color dispersed throughout said composition to impart a decorative appearance to the countertop, and wherein the outer surface of said panel has been ground and polished to expose at said outer surface planar portions of said decorative particles in a surrounding planar matrix of pigmented epoxy resin.

16. A countertop comprising a monolithic, cast chemical and heat resistant surfacing panel formed of a cured, thermoset composition comprising an epoxy resin, mineral filler and pigments, said panel comprising a thin sheet having substantially planar inner and outer surfaces, a thickness of up to about ⅜ inch, a width at least 50 times its thickness, and a length at least 100 times its thickness;

a backing panel adhered to said inner surface of said surfacing panel to form a unitary composite structure; and wherein said backing panel comprises a rigid particle board panel having a substantially planar front surface, and wherein an adhesive layer is provided between a front surface of said backing panel and a rear surface of said surfacing panel securing the surfacing panel and the backing panel together to form a unitary composite structure.

17. A countertop according to claim 16, wherein said width is at least 100 times its thickness and its length is at least 250 times its thickness.

18. A countertop according to claim 16, wherein said backing panel comprises a rear panel extending parallel to said surfacing panel and spaced therefrom and a foam core disposed between said surfacing panel and said rear panel, said foam core comprising a rigid foam composition filling a space between said surfacing panel and said rear panel and being adhered to said surfacing panel and said rear panel, said foam core securing the surfacing panel and said rear panel together to form a unitary composite structure.

19. A countertop comprising a monolithic, cast chemical and heat resistant surfacing panel formed of a cured, thermoset resin composition, said panel comprising a thin sheet having substantially planar inner and outer surfaces and a thickness of up to about ½ inch, the planar outer surface defining a working surface of the countertop, and an edge flange portion integrally and continuously molded along an edge of said thin sheet, said edge flange having an inwardly facing surface adjoining the inner surface of said thin sheet and an outwardly facing surface adjoining an outer surface of the thin sheet and the countertop with an appearance of a monolithic thick slab.

* * * * *

UNITED STATES PATENT AND TRADEMARK OFFICE
Certificate

Patent No. 6,113,199 Patented: September 5, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of the patent is: David K. Foote and Kurt P. Rindoks.

Signed and Sealed this Sixth Day of March, 2001.

PETER M. CUOMO
*Superviosry Patent Examiner*
Art Unit 3636

UNITED STATES PATENT AND TRADEMARK OFFICE

CERTIFICATE OF CORRECTION

PATENT NO. : 6,113,199
DATED : September 5, 2000
INVENTOR(S) : Foote et al.

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| --4,751,125 | 6/1998 | Ofterdinger |
| 5,595,427A | 1/1997 | Peters et al. |
| 327,546 | 10/1885 | Hansen |
| 415,332 | 11/1889 | Payen |
| 1,430,763 | 10/1922 | Sivertson |
| 3,177,089 | 4/1965 | Marshall et al. |
| 3,594,460 | 7/1971 | Rechter et al. |
| 3,740,513 | 6/1973 | Peters, Jr. et al. |
| 3,816,234 | 6/1974 | Winfield |
| 4,083,743 | 4/1978 | Degens |
| 4,505,974 | 3/1985 | Hosler |
| 4,543,290 | 9/1985 | Brooker et al. |
| 4,910,073 | 3/1990 | Tamura et al. |
| 5,266,384 | 11/1993 | O'Dell et al. |
| 5,451,362 | 9/1995 | Wombwell et al. |
| 5,505,895 | 4/1996 | Bull et al. |
| 5,570,939 | 11/1996 | Scott --. |

Item [56], References Cited, insert the following:
-- FOREIGN PATENT DOCUMENTS

| | | |
|---|---|---|
| 1,080,049 | 8/1967 | Great Britain |
| 1,471,723A | 4/1977 | Great Britain |
| WO 91,19444 | 12/1991 | WIPO --. |

Item [56], References Cited, insert the following:
-- OTHER PUBLICATIONS
Slocum, Donald H., *The Future of Thermoset Products*, Part I, Cast Polymer Connection, Volume VI, 1997, pp. 30-35. --.

UNITED STATES PATENT AND TRADEMARK OFFICE

CERTIFICATE OF CORRECTION

PATENT NO. : 6,113,199
DATED : September 5, 2000
INVENTOR(S) : Foote et al.

It is certified that error appears in the above-identified patent and that said Letters Patent is hereby corrected as shown below:

Column 6,
Line 57, cancel "laboratory".

Column 8,
Claim 8, should read as follows:

18. A countertop comprising a monolithic, cast chemical and heat resistant surfacing panel formed of a cured, thermoset composition comprising an epoxy resin, mineral filler and pigments, said panel comprising a thin sheet having substantially planar inner and outer surfaces, a thickness of up to about 3/8 inch, a width at least 50 times its thickness, and a length at least 100 times its thickness;

a backing panel adhered to said inner surface of said surfacing panel to form a unitary composite structure;

wherein said backing panel comprises a rear panel extending parallel to said surfacing panel and spaced therefrom and a foam core disposed between said surfacing panel and said rear panel, said foam core comprising a rigid foam composition filling a space between said surfacing panel and said rear panel and being adhered to said surfacing panel and said rear panel, said foam core securing the surfacing panel and said rear panel together to form a unitary composite structure.

Column 8,
Line 64, after "and" insert -- presenting --.

Column 8,
After claim 19, please insert the following claim:

-- 20. A countertop comprising a monolithic, cast chemical and heat resistant surfacing panel formed of a cured, thermoset composition comprising an epoxy resin, mineral filler and pigments, said panel comprising a thin sheet having substantially planar inner and outer surfaces and a thickness of up to about 1/2 inch, the planar outer surface defining a working surface of the countertop, and an edge flange portion integrally and continuously molded along an edge of said thin sheet, said edge flange having an inwardly facing surface adjoining the inner surface of said thin sheet and an outwardly facing surface adjoining an outer surface of the thin sheet and presenting the countertop with an appearance of a monolithic thick slab. --.

UNITED STATES PATENT AND TRADEMARK OFFICE

CERTIFICATE OF CORRECTION

PATENT NO. : 6,113,199
DATED : September 5, 2000
INVENTOR(S) : Foote et al.

It is certified that error appears in the above-identified patent and that said Letters Patent is hereby corrected as shown below:

Column 8,
After inserting claim 20, please insert the following claim:

-- 21. A countertop comprising a monolithic, cast chemical and heat resistant surfacing panel formed of a cured, thermoset composition comprising an epoxy resin, mineral filler and pigments, said panel comprising a thin sheet having substantially planar inner and outer surfaces, a thickness of up to about 3/8 inch, a width at least 50 times its thickness, and a length at least 100 times its thickness;

a backing panel adhered to said inner surface of said surfacing panel to form a unitary composite structure; and wherein said backing panel is a rigid panel made of a material selected from the group consisting of wood, plywood, particle board, chip board, plastics, cement board, structural foam, honeycomb panels, and corrugated panels, and wherein an adhesive layer is provided between a front surface of said backing panel and a rear surface of said surfacing panel securing the surfacing panel and the backing panel together to form a unitary composite structure. --.

Signed and Sealed this

Fifth Day of February, 2002

*Attest:*

*Attesting Officer*

JAMES E. ROGAN
*Director of the United States Patent and Trademark Office*